US007397190B2

(12) United States Patent
Derra et al.

(10) Patent No.: US 7,397,190 B2
(45) Date of Patent: Jul. 8, 2008

(54) GAS DISCHARGE LAMP FOR EXTREME UV RADIATION

(75) Inventors: Guenther Hans Derra, Aachen (DE); Joseph Robert Rene Pankert, Aachen (DE); Willi Neff, Kelmis (BE); Klaus Bergmann, Herzogenrath (DE); Jeroen Jonkers, Aachen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 364 days.

(21) Appl. No.: 10/536,918

(22) PCT Filed: Nov. 28, 2003

(86) PCT No.: PCT/IB03/05496

§ 371 (c)(1),
(2), (4) Date: Jan. 9, 2006

(87) PCT Pub. No.: WO2004/051698

PCT Pub. Date: Jun. 17, 2004

(65) Prior Publication Data

US 2006/0138960 A1 Jun. 29, 2006

(30) Foreign Application Priority Data

Dec. 4, 2002 (DE) ..... 102 56 663

(51) Int. Cl.
*H01J 61/09* (2006.01)

(52) U.S. Cl. ..... 313/618; 313/491; 313/574; 313/326; 313/299

(58) Field of Classification Search ..... None
See application file for complete search history.

(56) References Cited

U.S. PATENT DOCUMENTS

| | | | | |
|---|---|---|---|---|
| 5,467,362 | A * | 11/1995 | Murray | 372/5 |
| 6,452,194 | B2 * | 9/2002 | Bijkerk et al. | 250/492.2 |
| 2002/0168049 | A1 * | 11/2002 | Schriever et al. | 378/119 |

FOREIGN PATENT DOCUMENTS

| | | |
|---|---|---|
| WO | WO 01 01736 | 1/2001 |
| WO | WO 0191532 | 11/2001 |

* cited by examiner

*Primary Examiner*—Ashok Patel

(57) ABSTRACT

The invention relates to a gas discharge lamp for EUV radiation with an anode (1) and a hollow cathode (2), wherein the hollow cathode (2) has at least two openings (3, 3') and the anode (1) has a through hole (4), which is characterized in that the longitudinal axes (5, 5') of the hollow cathode openings (3) have a common point of intersection S lying on the axis of symmetry (6) of the anode opening (4).

13 Claims, 13 Drawing Sheets

GAS DISCHARGE LAMP FOR EXTREME UV RADIATION

Figure 1:
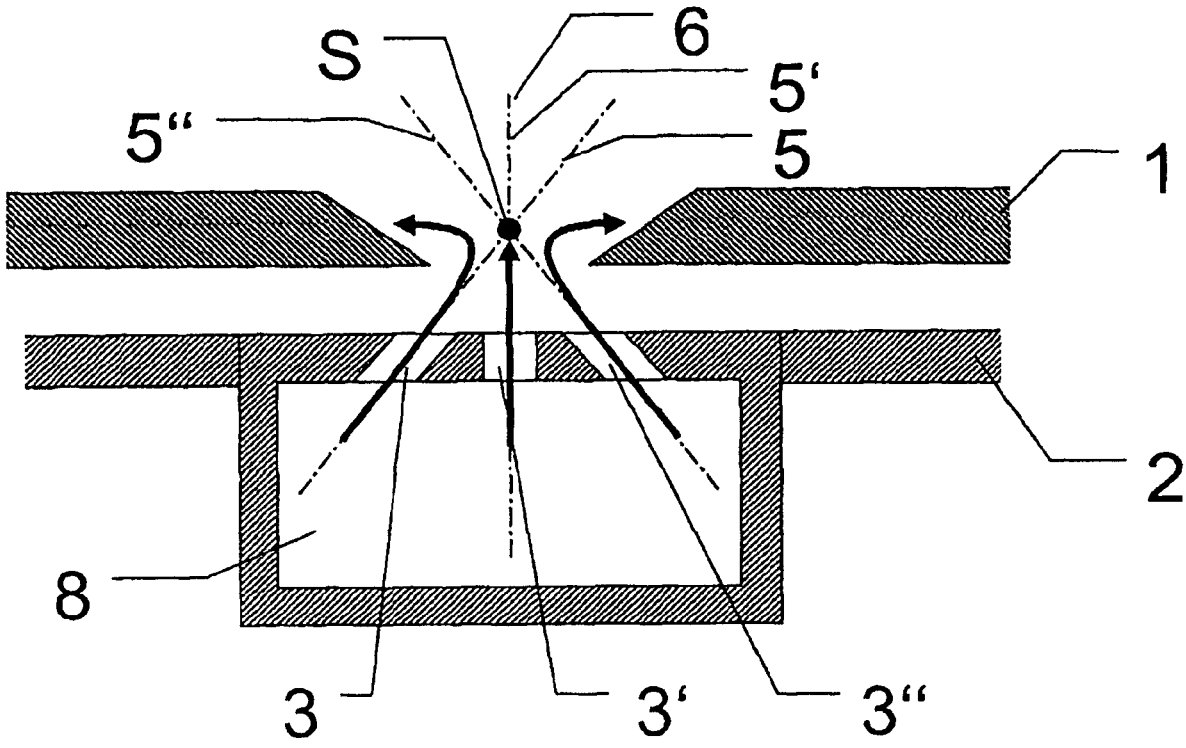

The invention relates to a gas discharge lamp for extreme ultraviolet radiation as defined in the pre-characterizing part of claim 1. Preferred fields of application are those in which extreme ultraviolet (EUV) radiation is required, preferably in a wavelength range from approximately 10 to 20 nm, for example in semiconductor lithography.

The use of a dense hot plasma as a radiation-emitting medium for providing EUV radiation is generally known.

WO 01/91532 A2 for this purpose discloses the use of an EUV radiation source with a plurality of partial electrodes arranged in the shape of a circular segment, between which ion beams are accelerated. The ion beams issue into a plasma discharge space and form a dense hot plasma there which emits radiation in the EUV wavelength range. To reduce the divergence of the ion beams, and also to provide a particularly small plasma volume, additional means are provided for electrically neutralizing the ions.

A device for generating EUV and soft X-beam radiation is disclosed in WO 01/01736 A1, where two main electrodes are provided between which a gas-filled intermediate space is present. The main electrodes each have one or several openings. The configuration of the main electrodes achieves that the plasma is ignited only inside the cylinder defined by the diameter of the two central openings, and is subsequently compressed to an even smaller cylinder by the pinching effect. Only a single plasma channel is formed in this manner.

The invention has for its object to solve the technical problem of providing a gas discharge lamp with a pinch plasma emitting in the EUV wavelength range whereby a spatially strongly localized plasma is generated, while at the same time the erosion of the cathode material is as small as possible.

The solution of this technical problem is achieved by means of the characteristics of the independent claim 1. Advantageous further embodiments are given in the dependent claims.

It was recognized, according to the invention, that the technical problem mentioned above is solved by means of a gas discharge lamp for extreme ultraviolet radiation with an anode and a hollow cathode, wherein the hollow cathode has at least two openings and the anode has a through opening, and wherein the longitudinal axes of the hollow cathode openings have a common point of intersection S which lies on the axis of symmetry of the anode opening.

The invention is based on the recognition that the cathode erosion can be reduced in that the entire stream of electrodes originating from the cathode is distributed over several cathode openings. The cathode of a gas discharge source has to supply a very considerable flow of electrons of several kiloamperes during a current pulse. This leads to the formation of so-termed cathode spots in the inner surface of the cathode opening as well as in the immediately adjoining surface region of the cathode facing the anode. The electrons issue by preference from these cathode spots. In these locations, however, an erosion of the cathode material may take place far in excess of the purely thermal evaporation. The choice of a plurality of hollow cathode openings reduces the current density occurring in a cathode spot. This results overall in a smaller erosion of the cathode, in particular in the region of the opening, and to an improved operational life of the gas discharge lamp.

FIG. 1 shows a gas discharge lamp according to the invention with an anode 1 and a hollow cathode 2, where the latter has three cathode openings 3, 3', 3" leading to a hollow space 8. The anode 1, cathode 2, and hollow space 8 are present in a gas atmosphere at pressures of typically 1 to 100 Pa. A voltage is applied to the electrode system. The gas pressure and electrode distance are chosen such that the ignition of the plasma takes place at the left-hand branch of the Paschen curve, i.e. the ionization processes start along the long electrical field lines, which occur by preference in the region of the openings of the anode and cathode. The hollow cathode space 8 is not free from potential during the discharge, but the potential or the electrical field lines also extend into the hollow cathode space 8. A hollow cathode plasma arises there with a high efficiency of the plasma formation because of oscillating electrons.

Figure 2A:
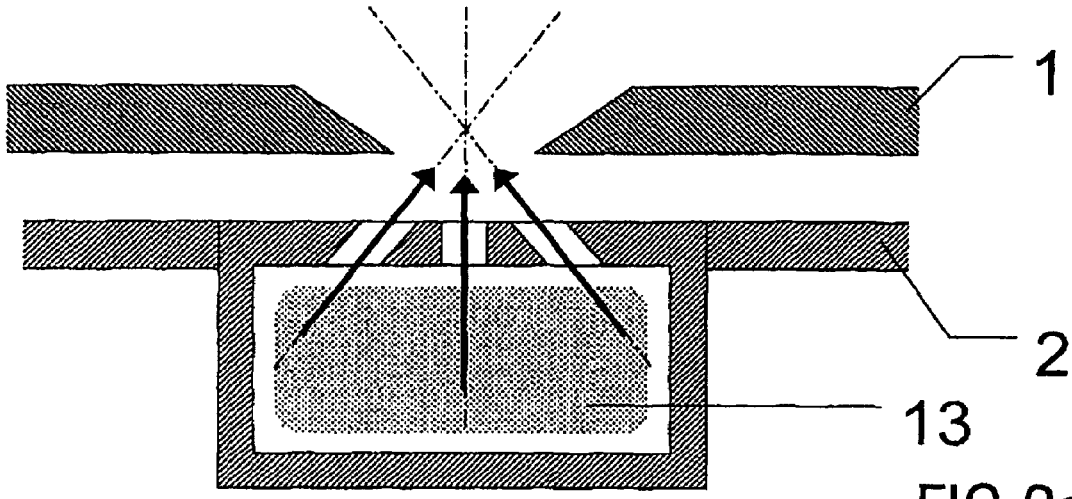

A highly conductive plasma arises in the region between anode and cathode as a result of this hollow cathode plasma and in particular also owing to the electron beam generated in the hollow cathode plasma, which beam extends through the openings 3, 3', 3" in the direction of the anode, i.e. in the direction of the arrow, cf. also FIG. 2*a*. The electrical conductivity is very high in particular in the region of the point of intersection S.

This plasma is compressed and heated up by a pulsed current in a range of between 1 and 100 kiloamperes such that it generates radiation in the extreme ultraviolet range. The amplitudes and cycle durations of the current pulses are chosen such that the plasma forms a source of EUV radiation. This plasma arises preferably in the region of the point of intersection S.

FIG. 1 shows an arrangement with planar electrodes 1, 2 which can be realized technically in a particularly simple manner. An alternative possibility is an arrangement in the form of a circular segment such as shown, for example, in FIG. 3 with a hollow cathode 2 forming a circular segment. This arrangement has the advantage that the electrode walls are farther removed from the plasma, cooling of the electrodes becomes easier, and greater angles to the axis of symmetry 6 can also be realized. In this construction, the wall 7 lying opposite the respective cathode opening 3, 3', 3" can always be perpendicular to the longitudinal axis 5, 5', 5" of this opening, and can thus promote through ionization in the intervening space between the electrodes that a high electrical conductivity arises by preference in the region of the common point of intersection S.

The current pulses used advantageously have amplitudes of between 10 and 100 kiloamperes and cycle durations in a range between 10 and 1000 ns. The plasma is sufficiently compressed and accordingly heated up in particular in the case of these parameter values for the current pulses, such that the temperature required for the radiation emission is achieved.

Xenon is mainly used as the operational gas for the discharge source, in pure form or mixed with other gases. Alternatively, however, gases with other radiators such as, for example, lithium or tin, in elementary form or as chemical compounds, may be used so as to obtain as high as possible a radiant efficiency. The working pressure lies in a region of approximately 1 to 100 Pascal. The operating point is chosen such that the product of electrode distance and discharge pressure lies on the left-hand branch of the Paschen curve. The ignition voltage in this case rises with a decreasing gas pressure, given a certain electrode geometry.

Figure 2B:
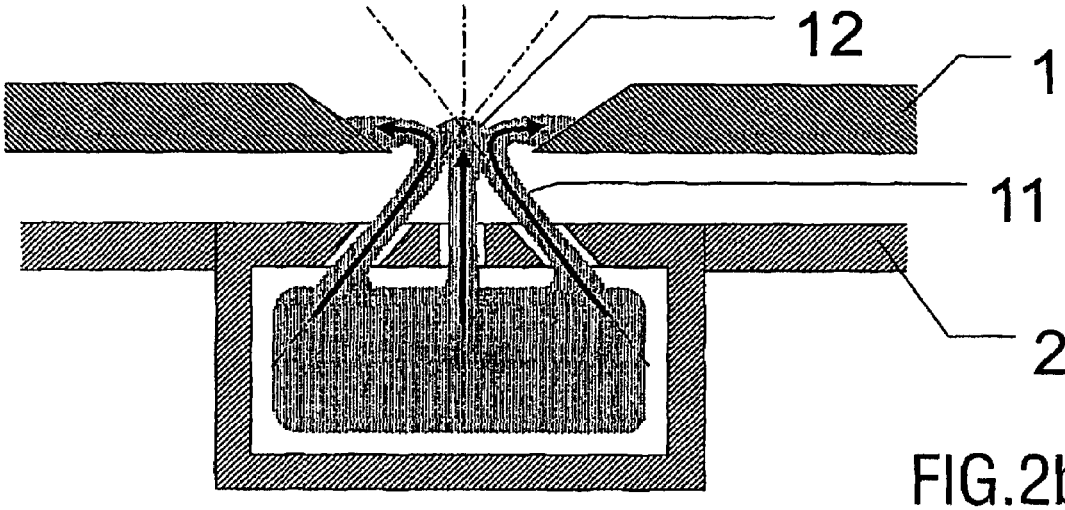

At the start of the discharge, i.e. when the current starts to flow, a plasma 13 is generated in the hollow cathode 2 as shown in FIG. 2*a*. This plasma 13 passes through the cathode openings in the course of the discharge and forms conductive channels 11 between the cathode and the anode, see FIG. 2*b*. It is apparent from the above that the beam 11 of ions and electrons issuing from the hollow cathode openings will have a certain spatial dimension. The common point of intersection S should accordingly be interpreted as being that spatial region 12 within which these spatial beams intersect or overlap one another.

Figure 2C:
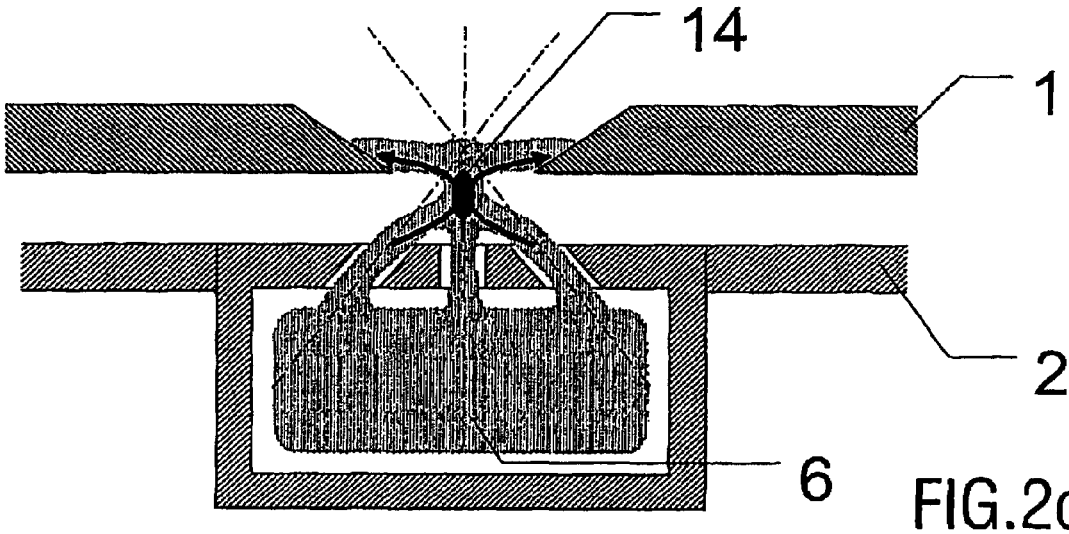

A fast rise in the current takes place along the channels 11, as a result of which the plasma of FIG. 2*c* is magnetically compressed to a small volume 14 on the axis of symmetry 6 of the arrangement. A cigar-shaped plasma can thus be realized on and in the direction of the main axis of symmetry 6. The length of this plasma region in axial direction is approximately 2 to 5 mm, and perpendicularly thereto approximately 0.5 to 2 mm. The center of gravity of this plasma region lies approximately in the point of intersection S. The strong rise in temperature causes the gas atoms present here to be repeatedly ionized and to emit the desired EUV radiation.

The alignment of the hollow cathode openings towards a common point of intersection S achieves that the electron or plasma beams generated in the initial phase of the discharge meet in one point, i.e. the point of intersection S, and thus provide current channels directed at one point in space. A very strongly localized plasma is formed in this manner owing to the pinching effect in the later phase with higher current flows.

According to the invention, at least two cathode openings are provided, and the use of a greater number of cathode openings is advantageous. The use of a greater number of cathode openings increases the electrode surface area still further and reduces the load experienced by each individual cathode opening. This reduces the cathode erosion in a desirable manner.

Figure 3:
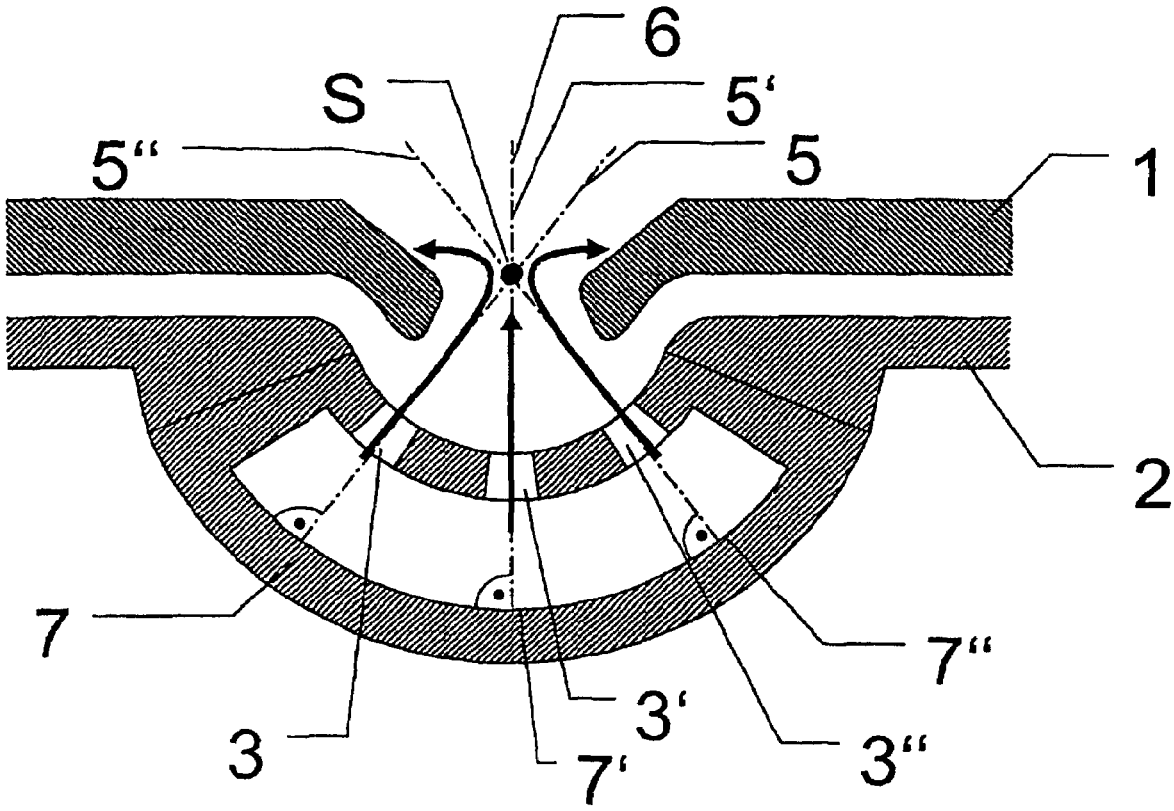

It is favorable if the longitudinal axis 5 of the respective hollow cathode opening 3 is substantially perpendicular to the portion of the hollow cathode wall 7 positioned opposite the hollow cathode opening 3, i.e. the rear wall of the hollow cathode space, cf FIG. 3. The orientation of the hollow cathode wall 7 with respect to the longitudinal axis of the hollow cathode opening in fact has a strong influence on the direction of the electron or plasma beam and on its current strength when it issues from the cathode opening.

This is because electrons are emitted from the rear walls 7 of the hollow cathode or hollow cathodes in the start phase of the discharge, i.e. perpendicularly to this wall each time. This leads to the formation of an electron beam followed by a beam of neutral plasma propagated through the respective openings 3, 3', 3" in the direction of the anode. Since the primary electron emission takes place perpendicularly to the wall of the hollow cathode, the charge carriers will then issue from the openings as completely as possible if the longitudinal axis of each opening is perpendicular to the hollow cathode rear wall.

The embodiments mentioned in the above sections have the common feature that the at least two hollow cathode openings lead into a single, and thus common hollow cathode space.

Figure 4A:
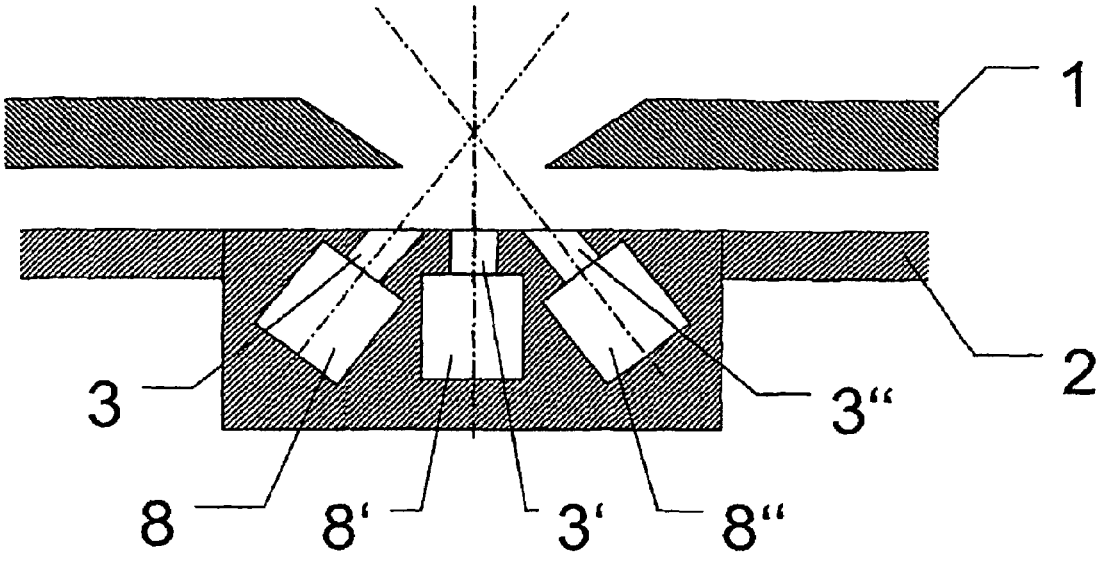
Figure 4B:
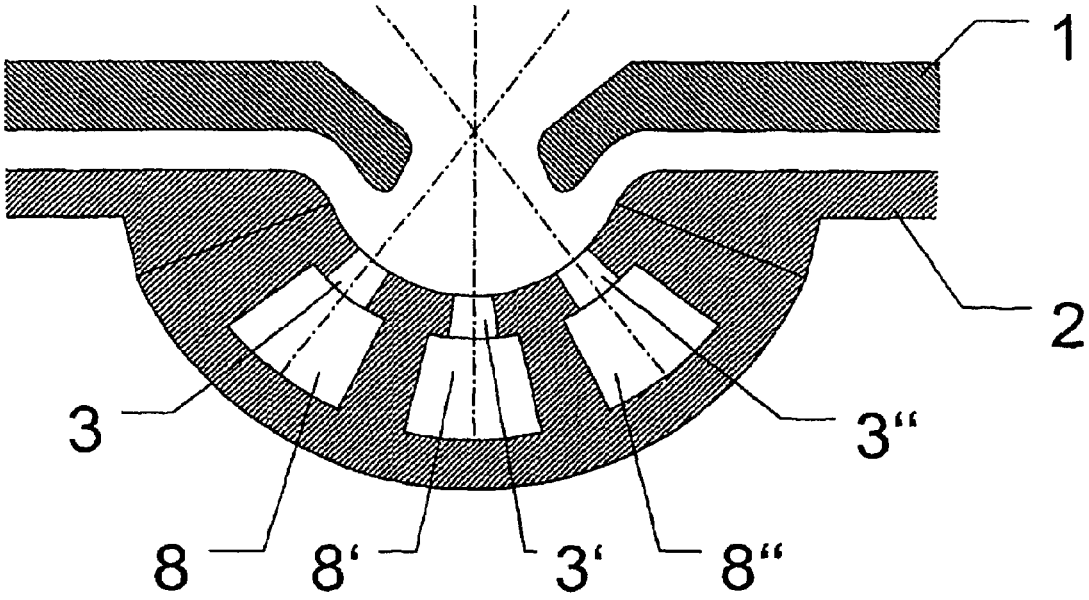

It is alternatively possible, however, that each hollow cathode opening 3, 3', 3" is associated with a separate hollow cathode space 8, 8', 8", cf. FIGS. 4*a* and 4*b*. In general, therefore, a hollow cathode may also be defined as a cathode with at least two opening 3, 3' with at least one associated hollow cathode space 8.

Separate hollow cathode spaces are smaller than a common hollow cathode space. The smaller size has the advantage that the plasma is more quickly recombined, so that higher repetition rates are possible.

Figure 5A:
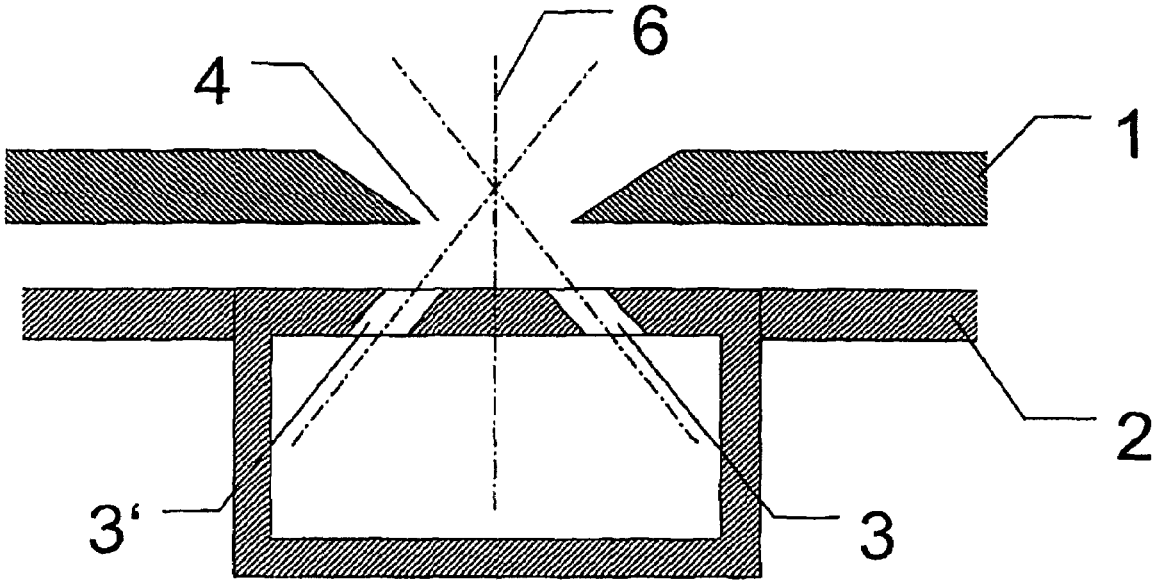
Figure 5B:
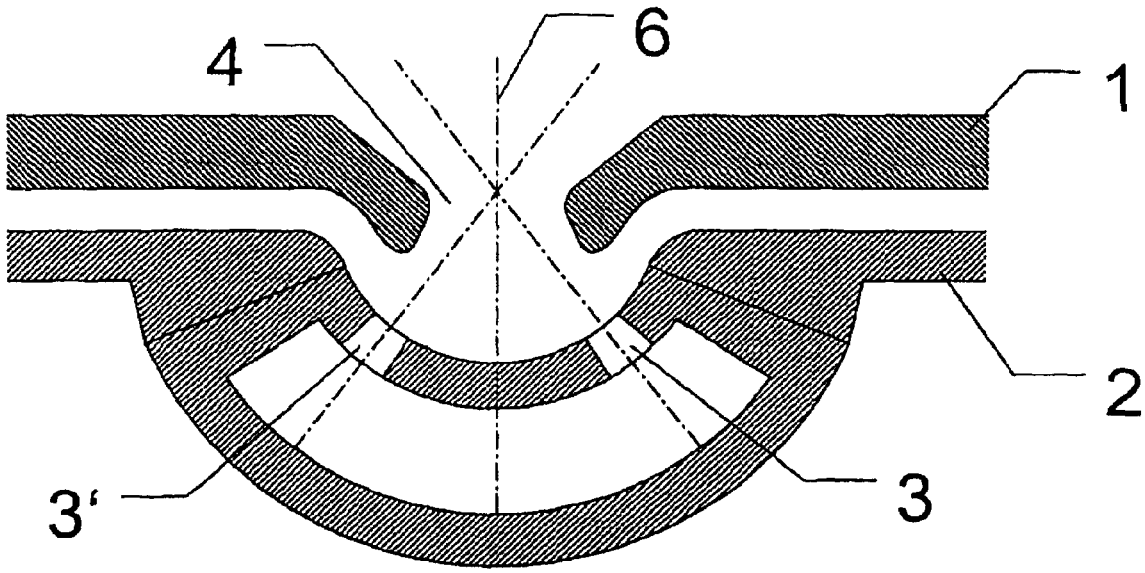

Another favorable embodiment of the invention is one in which the hollow cathode 2 has no opening on the axis of symmetry 8, cf. FIGS. 5*a* and 5*b*. It is experimentally demonstrated in the presence of an opening in this location, in fact, that the current flow originating from this opening often considerably exceeds the current flows originating from the other openings 3, 3'. If no opening is provided in this location, the risk is avoided that this opening will be subject to a particularly strong erosion. In other words, the distribution of the total current over the individual currents is particularly homogeneous.

FIGS. 5*a* and 5*b* show modifications without hollow cathode openings on the axis of symmetry 6, in which the respective openings 3, 3' share a common hollow space, but the above embodiments may equally well be given separate hollow spaces 8, 8', 8" as shown in FIG. 4*a* or 4*b*.

A modification not shown in the drawings consists in that a hollow cathode through hole is chosen on the axis of symmetry whose diameter is smaller than the diameters of the other hollow cathode openings. In this case the central hollow cathode opening, i.e. the hollow cathode opening on the (main) axis of symmetry of the electrode arrangement, plays no part in the ignition of the plasma. It is an advantage of this modification that an erosion by particles emitted in axial direction during the compression of the pinch plasma can be avoided.

Figure 6A:
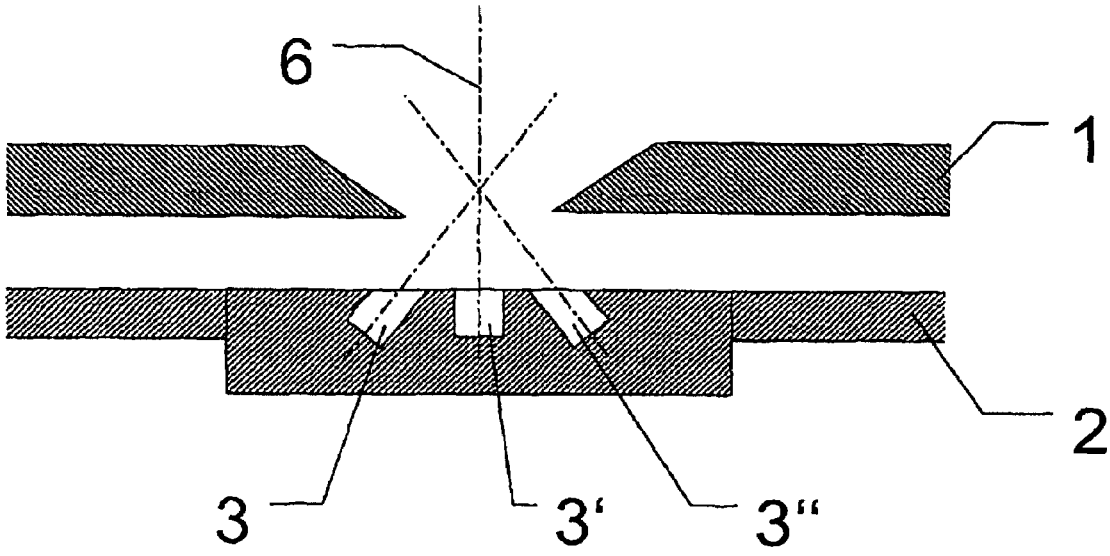
Figure 6B:
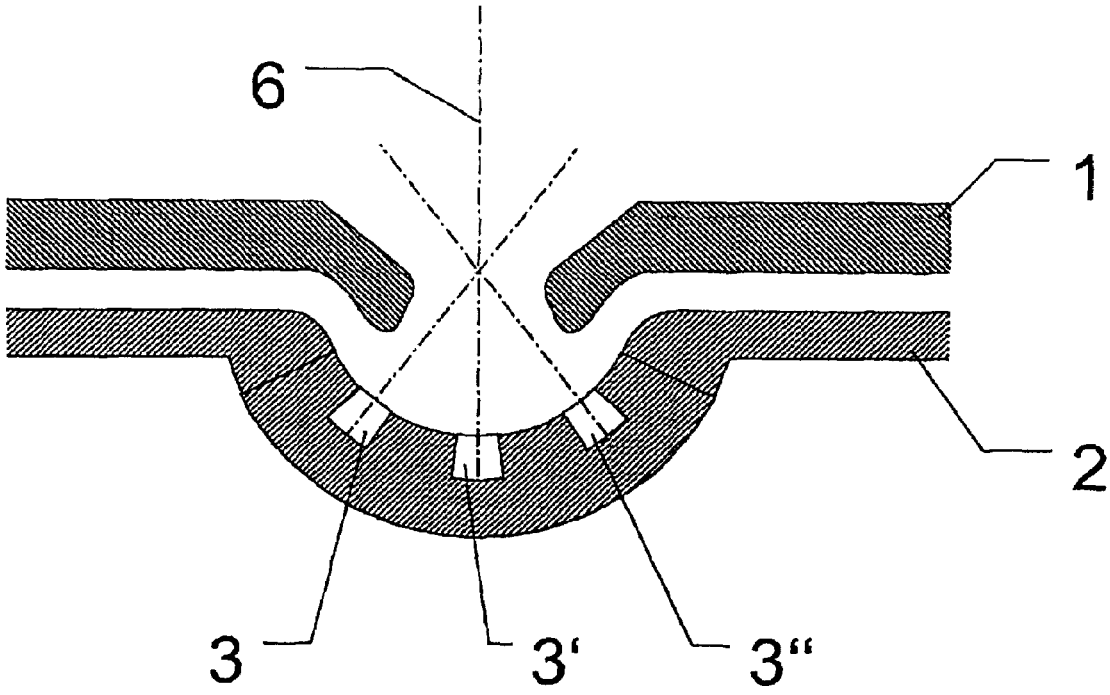

It may be provided in another embodiment that one or several hollow cathode openings 3, 3', . . . are formed as blind holes, cf. FIGS. 6*a* and 6*b*. This construction is particularly simple to manufacture.

Figure 6C:
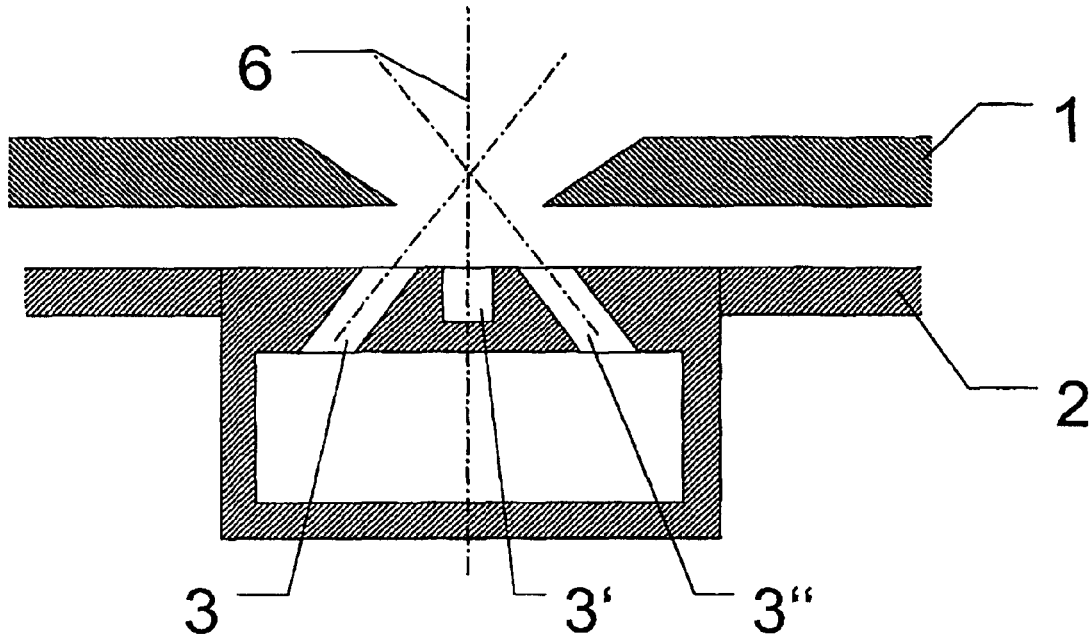
Figure 6D:
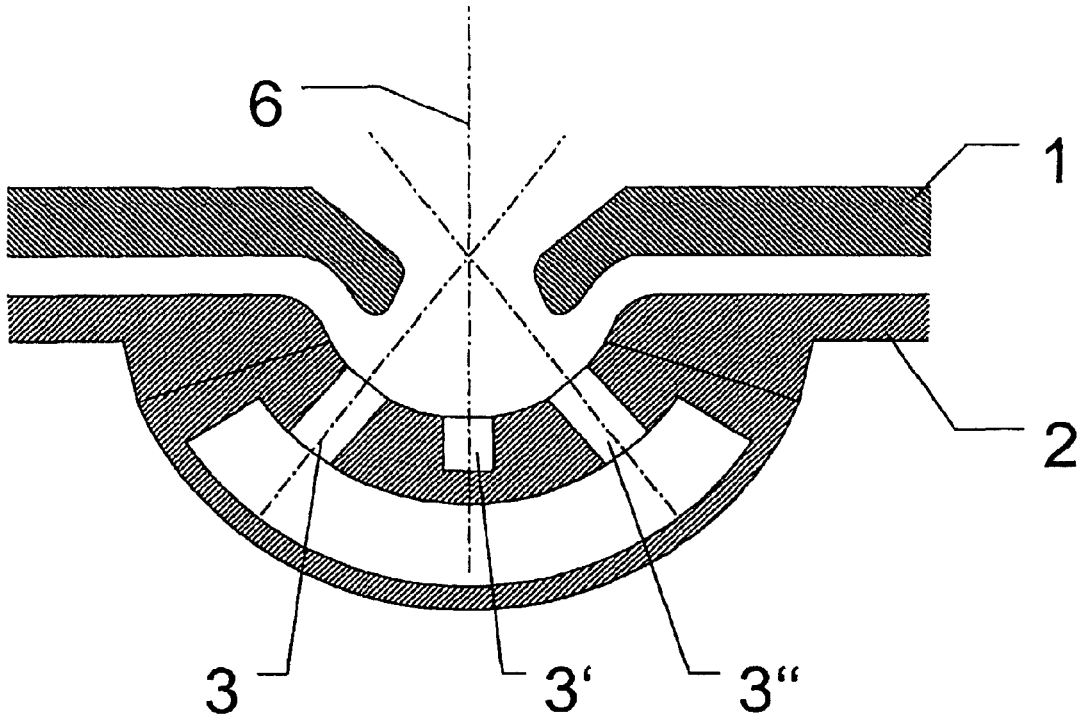

Experiments have further shown that the center of gravity of the plasma does not lie in the point S, but is often shifted in the direction of the cathode if the operational parameters are not optimized. The distance of the plasma to the cathode wall can be increased especially with a blind hole 3' on the axis of symmetry 6 as shown in FIGS. 6*c* and 6*d*, in particular if the diameter of the blind hole is greater than the diameter of the further hollow cathode openings 3, 3'. The increased distance of the plasma to the cathode wall leads to a further reduction in cathode erosion.

Furthermore, the arrangement is more tolerant with respect to erosion in the opening region in the case of a blind hole on the main axis of symmetry 6. Any rounding-off or abrasion of the cathode at the edge of the opening does not play as large a part for the current transport and thus for the pinch plasma in the case of a blind hole as in the case of a geometry with a through hole. In the latter case, the geometry of the pinch plasma is essentially determined by the current generation and its lateral development in the opening, where the experience is that the eroded edge has a negative influence on the pinch geometry. The pinch plasma becomes longer, with the result that less radiation can be coupled out. In this respect the blind hole has the effect that the plasma remains unchanged in its position and geometry in spite of any erosion occurring.

Figure 7:
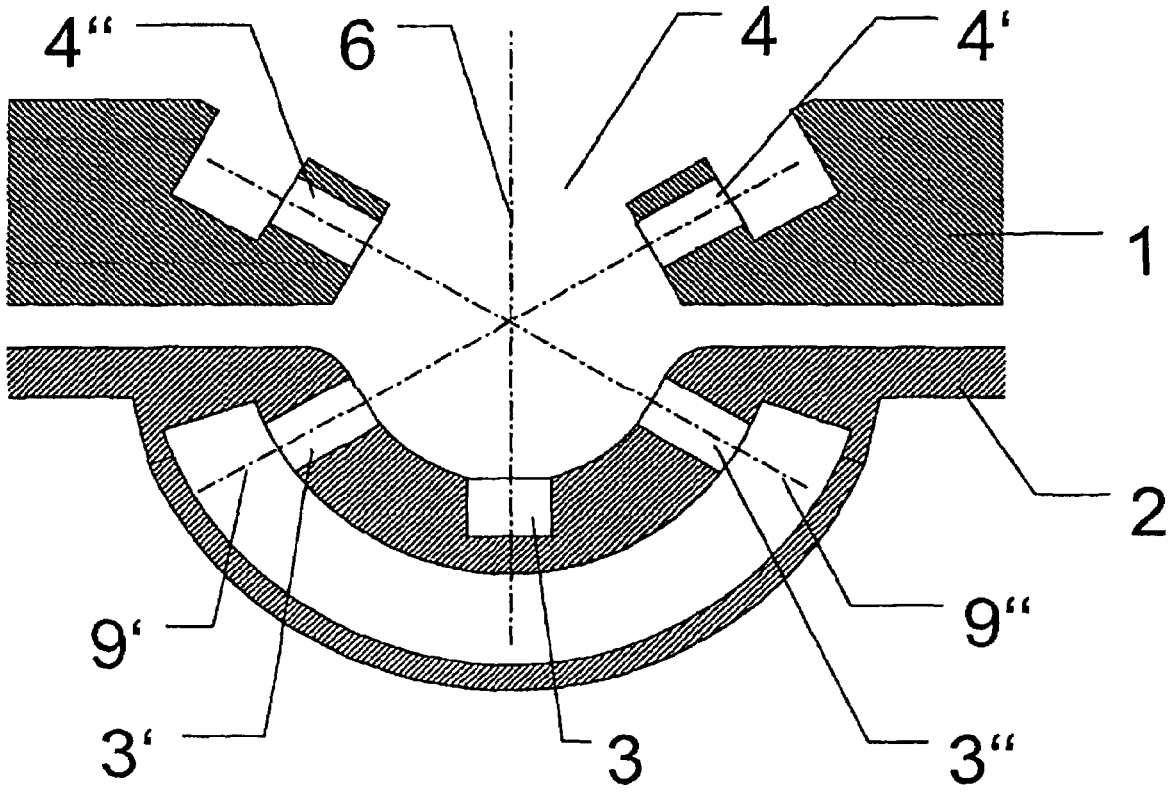

The anode 1 comprises a continuous central main opening 4 on the axis of symmetry 6. The anode 1 may have at least two further openings 4', 4" in addition to the continuous central main opening 4. The longitudinal axes 9' and 9" of these additional anode openings 4' and 4" are identical to the longitudinal axes of respective hollow cathode openings 3', 3", see FIG. 7. This means that each additional anode opening 4', 4" has an associated opposite hollow cathode opening 3', 3" not lying on the axis of symmetry. There will be overlapping plasma channels in the location S in this case, and the further anode openings 4', 4" substantially define the plasma volume to be compressed by the pinching effect. Since the additional anode openings 4', 4" have a smaller diameter than the central anode opening 4 on the axis of symmetry 6, the plasma volume to be compressed will become smaller overall. The plasma is thus compressed to an even smaller volume thereby. This has the advantage that an even greater proportion of the generated EUV radiation can be coupled out along the axis of symmetry 6 and can be usefully employed for the application. The erosion of the cathode material can be further reduced here in that lesser pulse energies are required for achieving a given EUV output power.

Figure 8A:
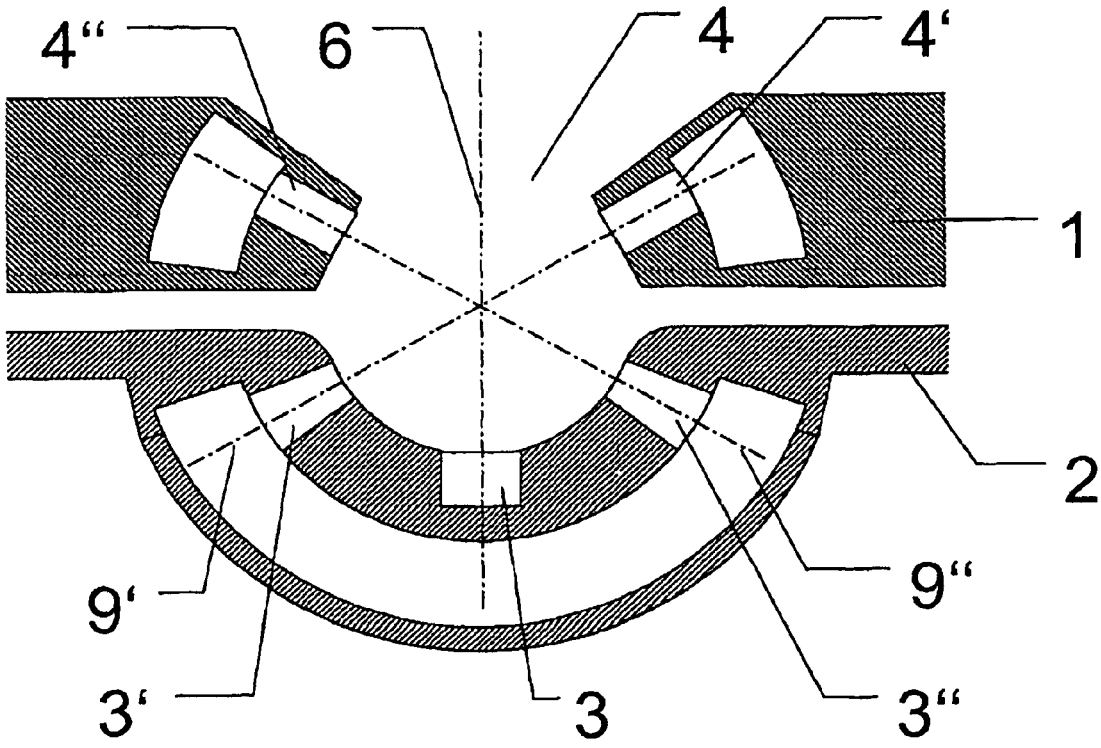
Figure 8B:
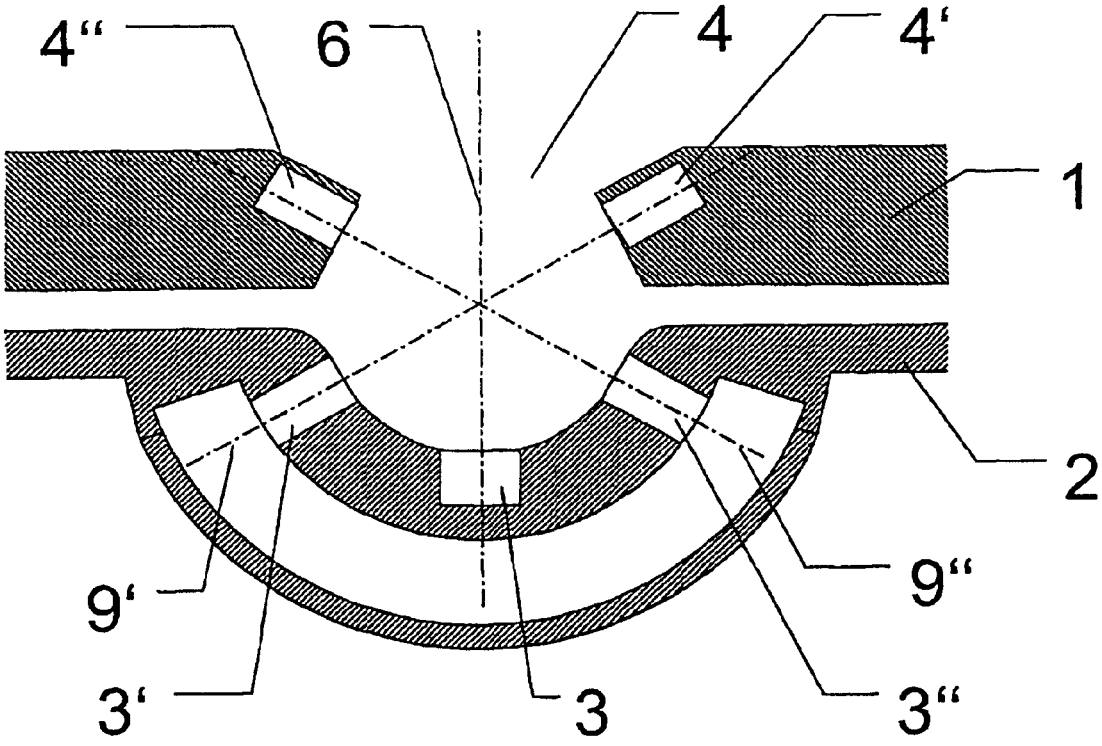

The additional anode openings may be of various dimensions. Viewed from the point S, an open spatial region is present behind the anode opening 4', 4" in FIG. 7, whereas this spatial region is closed in FIG. 8*a*. The closed construction has the effect that the plasma cannot be interfered with by what happens in said spatial region, and the plasma emission takes place particularly free from interference. The modification of FIG. 8*b* is constructionally particularly simple here, because the closed spatial region consists of an anode opening 4', 4" formed as a blind hole.

Irrespective of the presence or otherwise and the construction of the additional anode openings 4', 4", the main opening 4 may also be constructed as a grid whose open regions are in the form of stripes or a checkerboard. The grid acts as an electrical screening during the ignition phase of the plasma in this case. This embodiment of the central main opening of the anode is advantageous especially if additional anode openings are present. In that case, in fact, the ignition process is governed even more dominantly by the additional anode openings 4', 4", so that the plasma volume to be compressed will become even smaller overall.

In a further advantageous embodiment of the invention, trigger devices are provided for the hollow cathode space or spaces. The ignition of the discharge can be triggered in a precise manner as desired thereby. In particular, the simultaneousness of ignition of the partial discharges can be improved thereby.

Figure 9A:
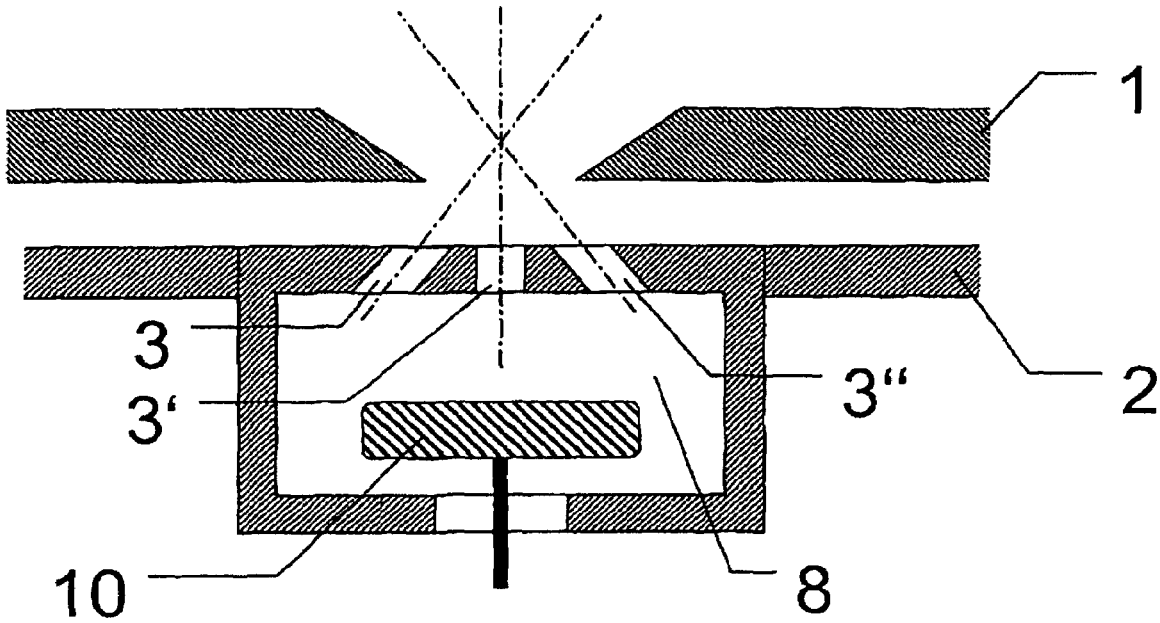
Figure 9B:
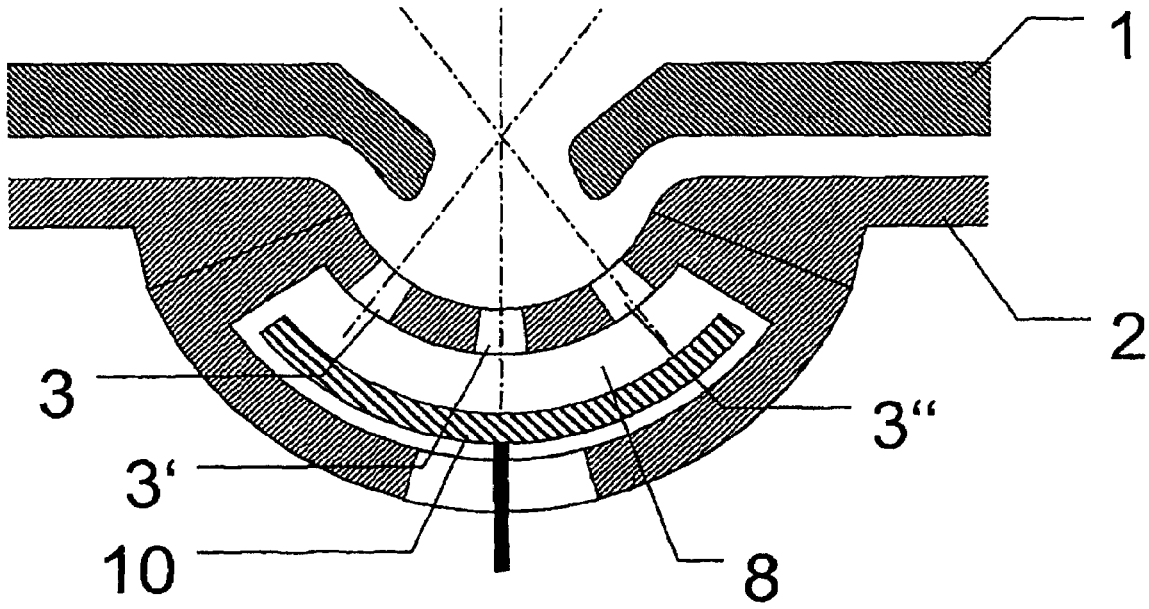

An additional electrode 10 may be provided in the hollow space 8 as a trigger device, see FIGS. 9*a* and 9*b*. This additional electrode 10 is capable of preventing the ignition of the discharge in that it is kept at a positive potential with respect to the cathode 2 by an electronic triggering device. When the trigger electrode is switched to cathode potential by a control pulse of the electronic triggering device, an exactly controllable ignition of the discharge is obtained. A similar effect is obtained in the case in which a dielectric trigger is used.

Figure 10A:
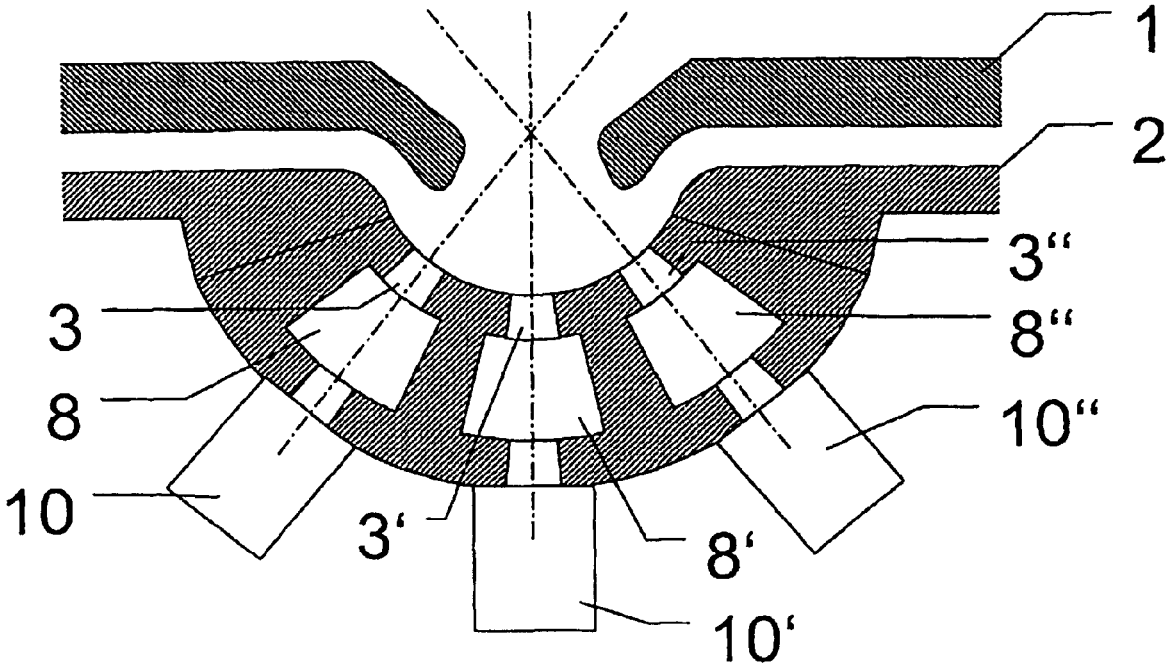

A pulsed high-frequency source 10, 10', 10" may be provided as the trigger device, see FIG. 10*a*, and a microwave source, for example, may be used for triggering the discharge. The high frequency is coupled into the hollow cathode space or spaces 8, 8', 8" through the opening in the direction of the dash-dot lines and initiates the build-up of the hollow cathode plasma and finally the main discharge there.

Figure 10B:
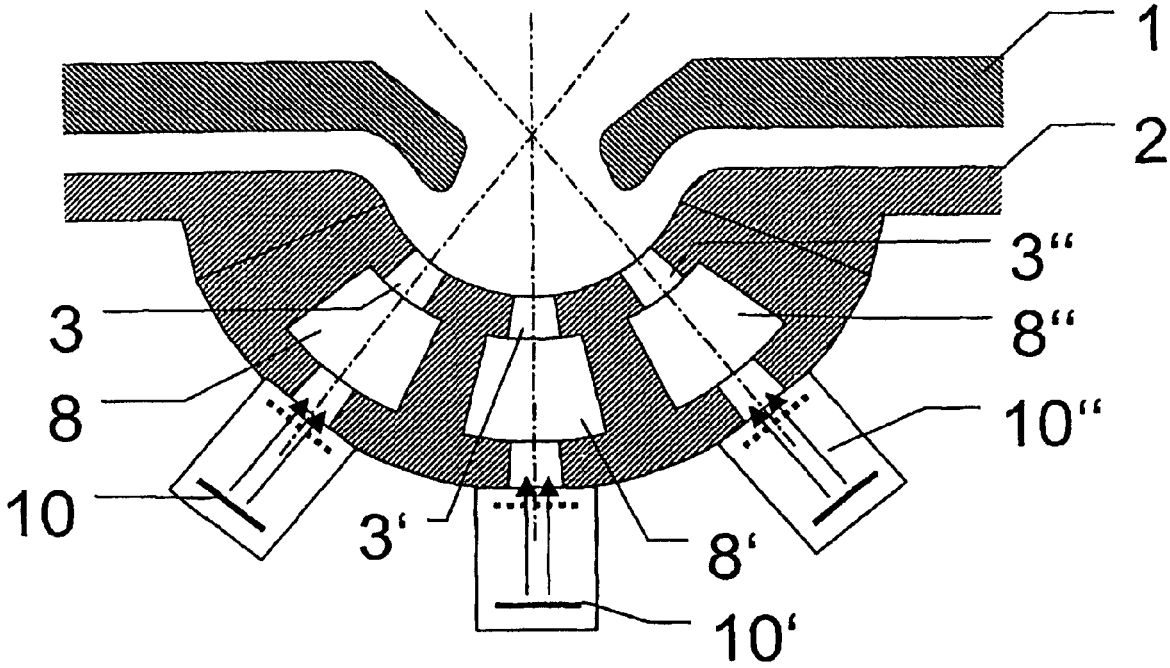

Glow discharge units may alternatively be provided for triggering, see FIG. 10*b*. A glow discharge is maintained inside these units before the actual main discharge. Electrons are extracted from the glow plasma through the application of a positive voltage pulse to the grid electrode facing the hollow cathode 2, which electrons initiate the main discharge in the hollow cathode space 8, 8', 8" and in the space between the anode and cathode, i.e. in the electrode intervening space.

Figure 10C:
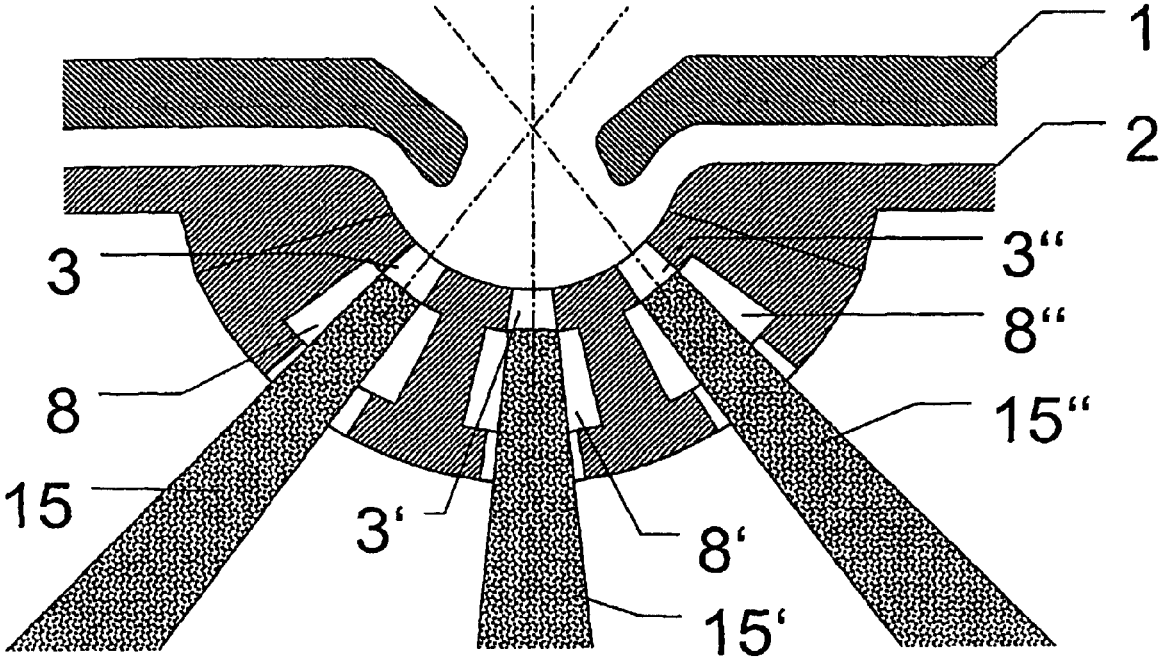
Figure 10D:
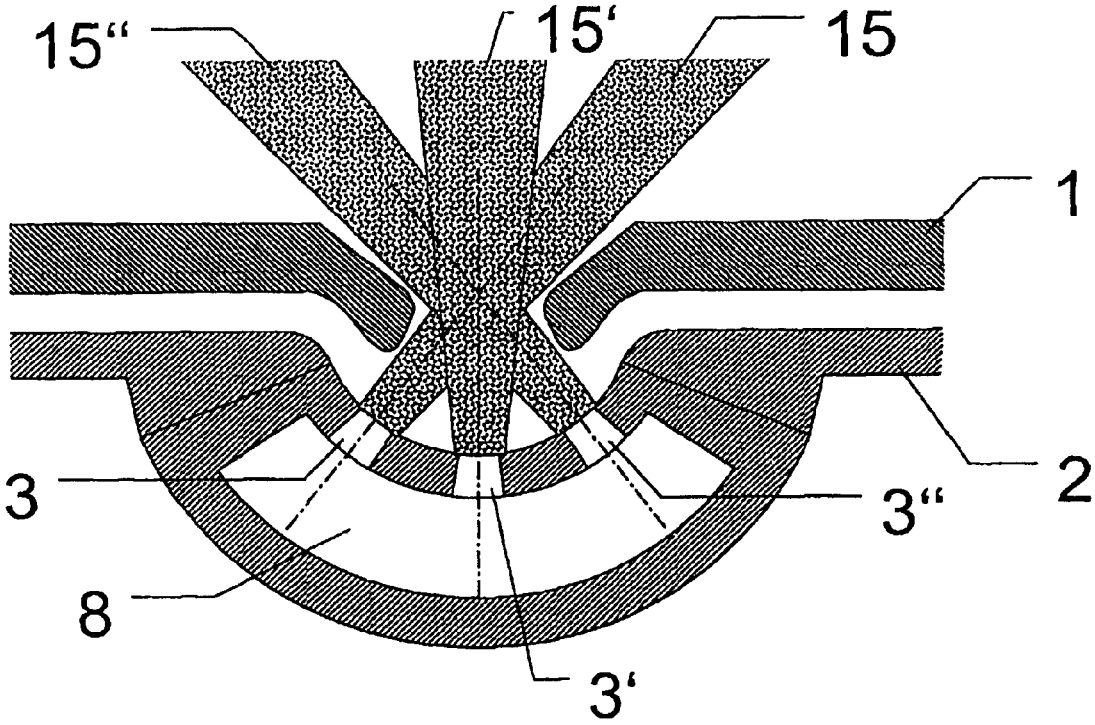

As is shown in FIGS. 10*c* and 10*d*, laser beams 15, 15', 15" of a pulsatory laser beam source focused on the respective hollow cathode openings may be used for triggering, so as to generate primary electrons from the cathode surface and to ignite the discharge. One or several focused laser beams may be introduced both from the anode side, see FIG. 10*d*, and through openings from the cathode side, see FIG. 10*c*.

Figure 11:
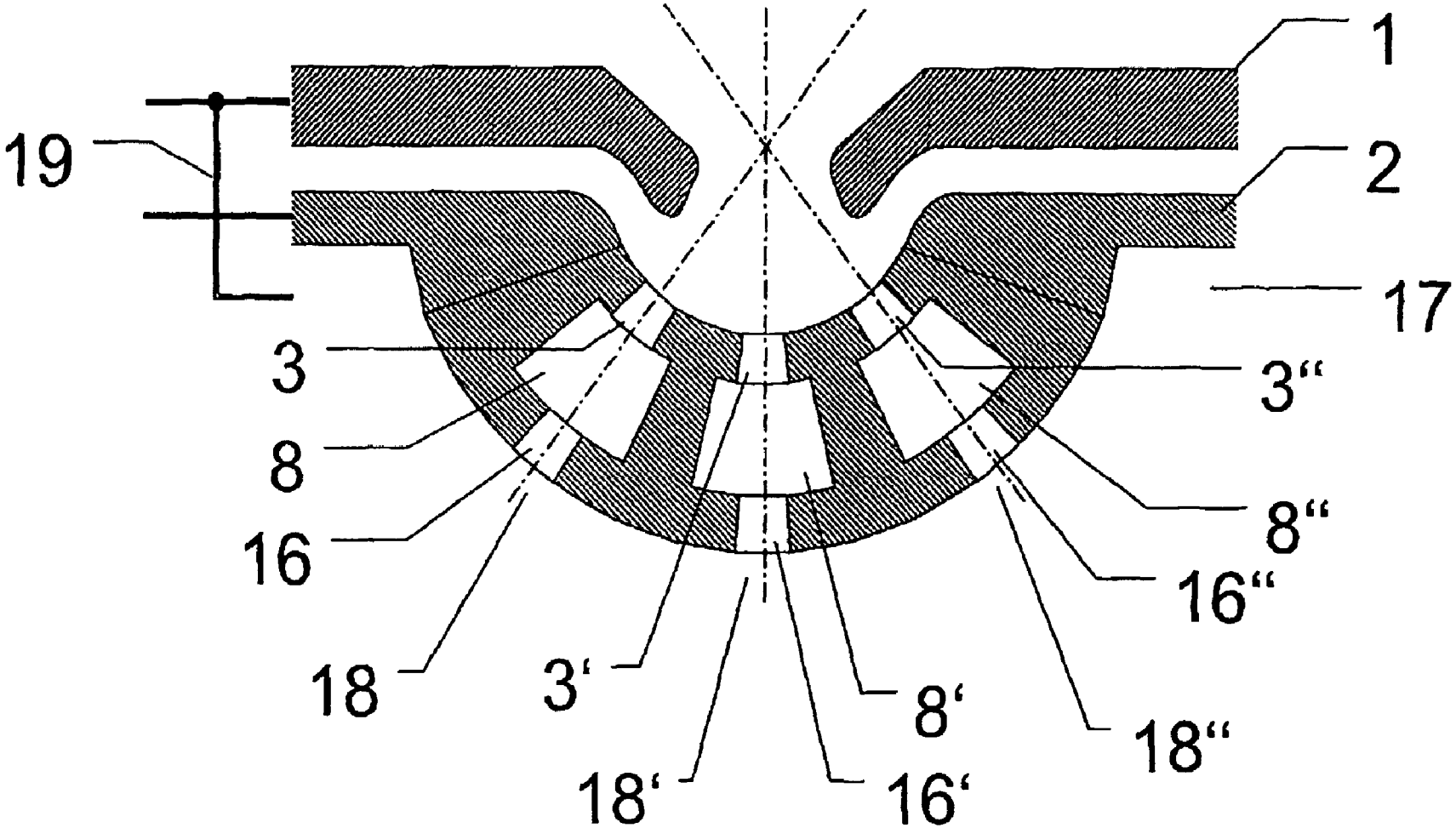

FIG. 11 shows a double plasma arrangement with an auxiliary anode 17. The auxiliary anode and the anode 1 are electrically interconnected via lines 19. A plasma is built up in the hollow cathode spaces 8, 8', 8" during the ignition phase of the discharge, from which plasma an electron beam is propagated in the direction of the anode 1 and also in the direction of the auxiliary anode 17. Subsequently a plasma arises in the space 18, 18', 18" between the openings 16, 16', 16" and the auxiliary anode 17, which plasma in its turn emits a beam of ions in the direction of the hollow cathode 2. The beam of ions passes through the hollow cathode space 8, 8', 8" and enters the electrode intervening space through the openings 3, 3', 3". This achieves a locally further enhanced ionization of the main plasma between the anode 1 and the cathode 2 along the beam of ions. The spatial dimension of the EUV radiation emitting plasma volume is even more reduced thereby. This provides a better coupling-out of the EUV radiation generated.

It is apparent from the embodiments described above that the various embodiments of cathode, anode or anodes, openings, and associated trigger devices may also be combined as desired.

LEGEND

1 anode
2 hollow cathode
3,3',3" hollow cathode opening
4 anode opening, through hole
5,5',5" longitudinal axis of a hollow cathode opening
6 axis of symmetry defined by anode through hole
7 hollow cathode rear wall
8,8',8" hollow cathode space
9 longitudinal axis of an additional anode opening
10 trigger device
11 beam of electrons and ions with spacial dimension
12 overlap region of electron beams
13 plasma
14 pinch plasma
15,15',15" laser beams
16,16',16" opening of the hollow cathode facing the auxillary anode
17 auxillary anode
18,18 ',18" intervening space between hollow cathode 2 and auxillary anode 17
19 electrical connection lines connecting the anode 1 and the auxillary anode 17 to one another

The invention claimed is:

1. A gas discharge lamp for EUV radiation with an anode (1) and a hollow cathode (2), wherein the hollow cathode (2) has at least two openings (3, 3') and the anode (1) has a through opening (4), characterized in that the longitudinal axes (5, 5') of the hollow cathode openings (3) have a common point of intersection S which lies on the axis of symmetry (6) of the anode opening (4).

2. A gas discharge lamp as claimed in claim 1, characterized in that the longitudinal axis (5) of each hollow cathode opening (3) is substantially perpendicular to the portion of the hollow cathode wall (7) situated opposite the respective hollow cathode opening (3).

3. A gas discharge lamp as claimed in claim 1, characterized in that each hollow cathode opening (3) is associated with a separate hollow cathode space (8).

4. A gas discharge lamp as claimed in claim 1, characterized in that a hollow cathode opening is formed as a blind hole.

5. A gas discharge lamp as claimed in claim 4, characterized in that the hollow cathode opening (3) present on the axis of symmetry (6) is formed as a blind hole.

6. A gas discharge lamp as claimed in claim 1, characterized in that the hollow cathode (2) has no opening (3) on the axis of symmetry (6) of the anode opening (4).

7. A gas discharge lamp as claimed in claim 1, characterized in that the hollow cathode (2) has a through hole on the axis of symmetry (6) of the anode opening (4), the diameter of said through hole being smaller than the diameter of the other hollow cathode openings.

8. A gas discharge lamp as claimed in claim 1, characterized in that the anode (1) has additional openings (4', 4") whose longitudinal axes (9', 9") each coincide with the longitudinal axis of a respective hollow cathode opening.

9. A gas discharge lamp as claimed in claim 8, characterized in that, viewed from the point of intersection S, the spatial region behind the additional anode opening (4', 4") is closed.

10. A gas discharge lamp as claimed in claim 8, characterized in that an additional anode opening (4', 4") is formed as a blind hole.

11. A gas discharge lamp as claimed in claim 8, characterized in that the central through hole of the anode (4) is formed as a grid whose open regions are strip-shaped or in the form of a checkerboard.

12. A gas discharge lamp as claimed in claim 1, characterized in that trigger devices (10) are provided for the hollow cathode space or spaces (8), preferably an additional electrode, a dielectric trigger, a pulsed high-frequency source, one or several glow discharge units, or a pulsed laser beam source.

13. A gas discharge lamp as claimed in claim 1, characterized in that a double plasma arrangement with an auxiliary anode (17) is provided as the trigger device.

* * * * *